US007628430B2

(12) United States Patent
Whitaker

(10) Patent No.: US 7,628,430 B2
(45) Date of Patent: Dec. 8, 2009

(54) HURRICANE STRUT FOR DOUBLE ENTRANCE DOORS

(75) Inventor: Malcolm A. Whitaker, 222 Venice Palms Blvd., Venice, FL (US) 34292

(73) Assignee: Malcolm A. Whitaker, Parrish, FL (US)

( * ) Notice: Subject to any disclaimer, the term of this patent is extended or adjusted under 35 U.S.C. 154(b) by 35 days.

(21) Appl. No.: 11/825,621

(22) Filed: Jul. 9, 2007

(65) Prior Publication Data

US 2009/0013607 A1 Jan. 15, 2009

(51) Int. Cl.
*E05C 19/18* (2006.01)

(52) U.S. Cl. ..... 292/259 R; 49/57

(58) Field of Classification Search ..... 49/57, 49/55; 292/339, 258, 259, 288
See application file for complete search history.

(56) References Cited

U.S. PATENT DOCUMENTS 212,242 A * 2/1879 Loper ..... 292/259 R
3,819,216 A * 6/1974 Richardson ..... 292/259 R
4,078,836 A * 3/1978 Wilson ..... 292/259 R
4,633,612 A * 1/1987 Forkish ..... 49/55
4,779,910 A * 10/1988 Dameron ..... 292/259 R
4,852,921 A * 8/1989 Gilbert et al. ..... 292/259 R
5,232,254 A * 8/1993 Teaff ..... 292/259 R
5,364,140 A * 11/1994 Rice ..... 292/259 R
5,605,364 A * 2/1997 Shelledy ..... 292/259 R
5,826,923 A * 10/1998 Bethurem ..... 292/259 R

* cited by examiner

*Primary Examiner*—Jerry Redman

(57) ABSTRACT

An adjustable square metal tubular strut, comprised of two square metal components, that when telescoped together and positioned horizontally at the center hinge pins on most width double entrance in-swinging doors, stops the deflection of said doors in wind load situations. The preferred embodiment of the strut is comprised of a plurality of predetermined holes for fastening the strut components together in any width configuration, and metal "U" shape straps attached to both ends of the strut with holes to receive the hinge pins, ultimately fixing the strut in place. Located along the face of the strut are a series of threaded holes of predetermined size and location, that where applicable, will receive two threaded torque screws, with a torque lever arm on the front end and a pressure foot on the inner end, that when tightened will firm the strut to the doors.

3 Claims, 5 Drawing Sheets

HURRICANE STRUT FOR DOUBLE ENTRANCE DOORS

BACKGROUND OF THE INVENTION

1. Field of the Invention

This invention relates, generally, to residential in-swinging double entrance doors and more particularly to a strut, placed horizontally at the mid hinge point of said doors, which effectively resists deflection of said doors against wind loading.

2. Prior Art

Patents of interest in this field are generally that of stronger door construction, stronger glass panes, and more recently, opening coverings, such as corrugated steel or Lexan and even plywood panels. In-swinging double doors, consisting of one "active" and one "inactive" door are especially vulnerable to wind loading because of the method of securing the inactive door with small diameter pins at the top of the header and at the threshold.

The APPLICANTS search of other PRIOR ART could only discover Patents of David K. Wegner U.S. Pat. No. 6,161,606, dated Dec. 19, 2000, J. M. Grisham U.S. Pat. No. 5,706,877, dated January 1998, W. Marko U.S. Pat. No. 5,732,758, dated March 1998, and R. Brenner U.S. Pat. No. 5,749,407, dated April 1998, all of which have relevance to that of strengthening GARAGE OVERHEAD DOORS utilizing either horizontal or vertical wind load struts. No PATENTED struts, having a similar embodiment and intended use as that of my invention, were discovered.

BRIEF SUMMARY OF THE INVENTION

Telescoping square metal tubes, that when attached in a horizontal position to the center hinge pins of any size residential in-swinging double entrance doors, will inhibit the deflection of same in a wind load situation.

BRIEF DESCRIPTION OF THE DRAWINGS

Drawing 1/5.

Drawing 2/5.

Drawing 3/5.

Drawing 4/5.

Drawing 5/5.

DETAILED DESCRIPTION OF THE DRAWINGS

Figure 1:
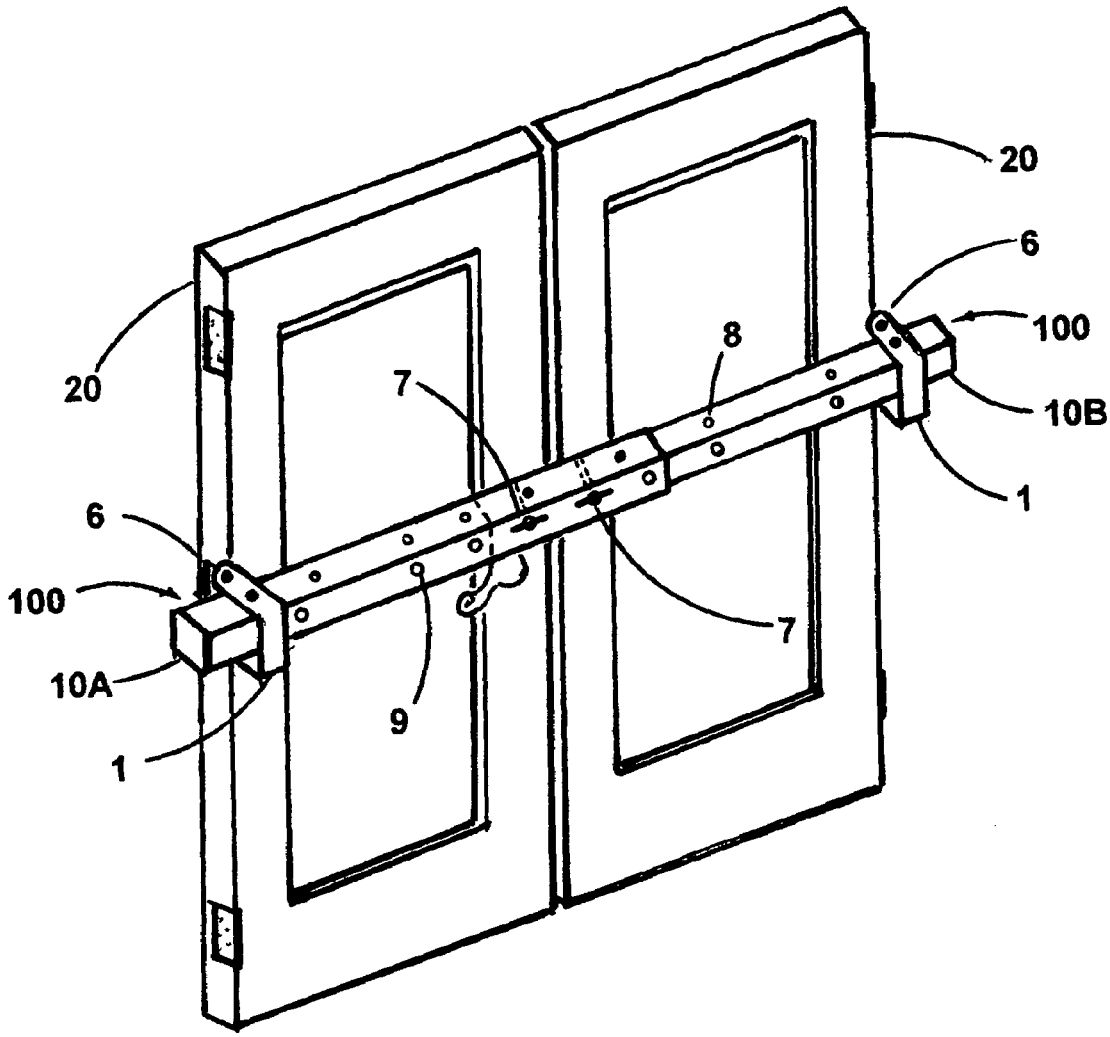
FIG. 1, is an isometric perspective view of a pair of in-swinging double entrance doors and a horizontal strut attached at the center hinge points.

Reference is made to DRAWING 1/5, FIG. 1, detailing the embodiment of the invention referenced as 100. Shown across the two doors 20 is a telescoping square metal tube 10A, and a second square metal tube 10B, with a plurality of ⅜" holes referenced as 8, located at predetermined locations on the top and bottom planar surface of said strut 100, for securing 10A and 10B together in any of four positions, as shown on drawing 4/5, FIGS. 6,7,8, & 9. Threaded holes 9 of predetermined size and location on the front face of said strut 100 for receiving torque screw 7 as shown in detail on drawing 5/5, FIG. 11. Strut 100 is secured to doors 20 at the center hinge 6 locations by a metal "U" strap 1, attached to each end of strut 100 and as shown in more detail on drawing 3/5, FIGS. 4 & 5.

Figure 2:
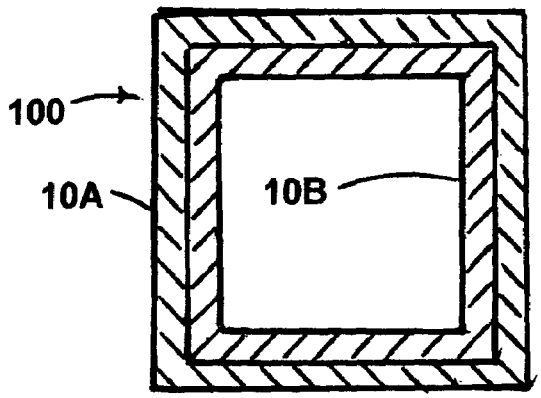
FIG. 2, is a section or cutting plane view of the two nestled square metal tube components that telescope to accommodate most width double doors.

FIG. 2 is an end view of square metal tube 10A, and square metal tube 10B in the telescoping position of said strut 100.

Figure 3:
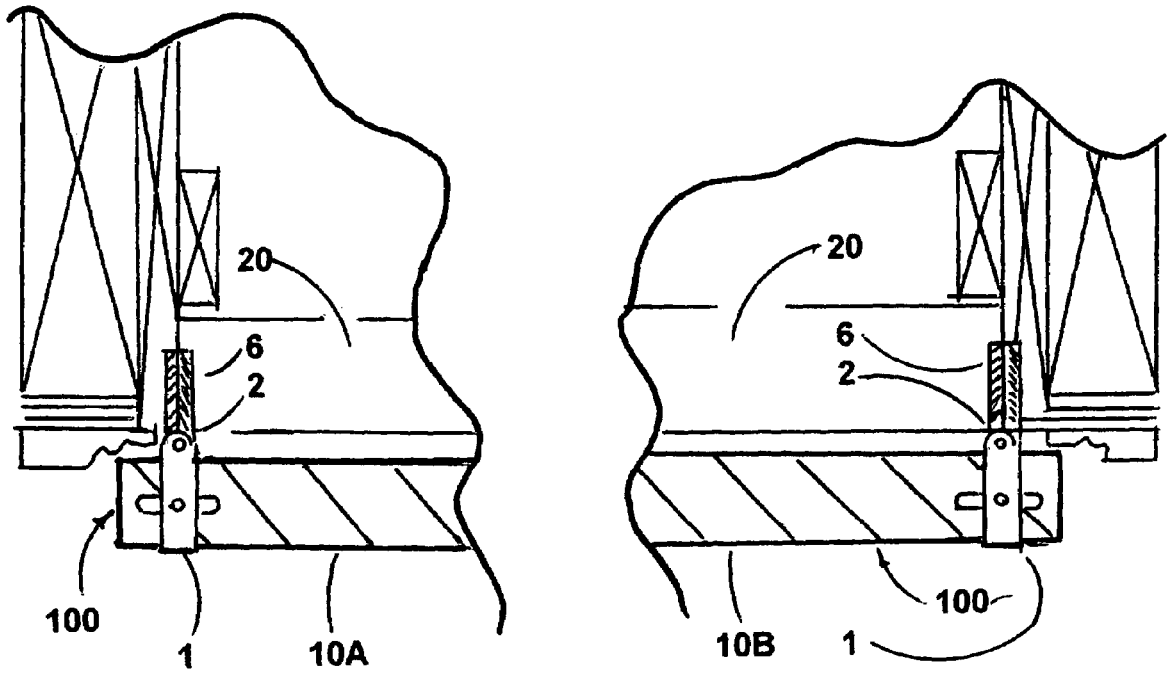
FIG. 3, is an aerial or top view of the strut as attached to the left and right center hinge pivot pins.

DRAWING 2/5, FIG. 3 are left and right hand top views of square metal tubes 10A and 10B, that comprise said strut 100, shown attached to doors 20 at the hinge 6 location by a metal strap 1 and a hinge 6 replacement pivot pin 2 at the left and right center hinge 6 area of doors 20.

Figure 4:
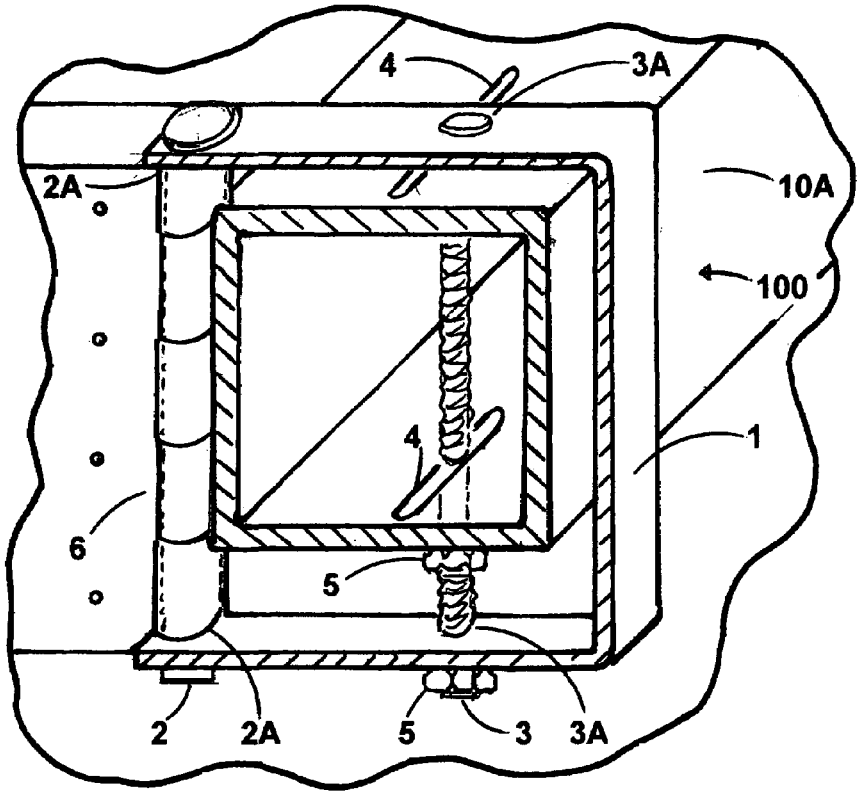
FIG. 4, is an isometric end view, showing the tubular strut, the strap attached to the strut and to the hinge pivot pin.
Figure 5:
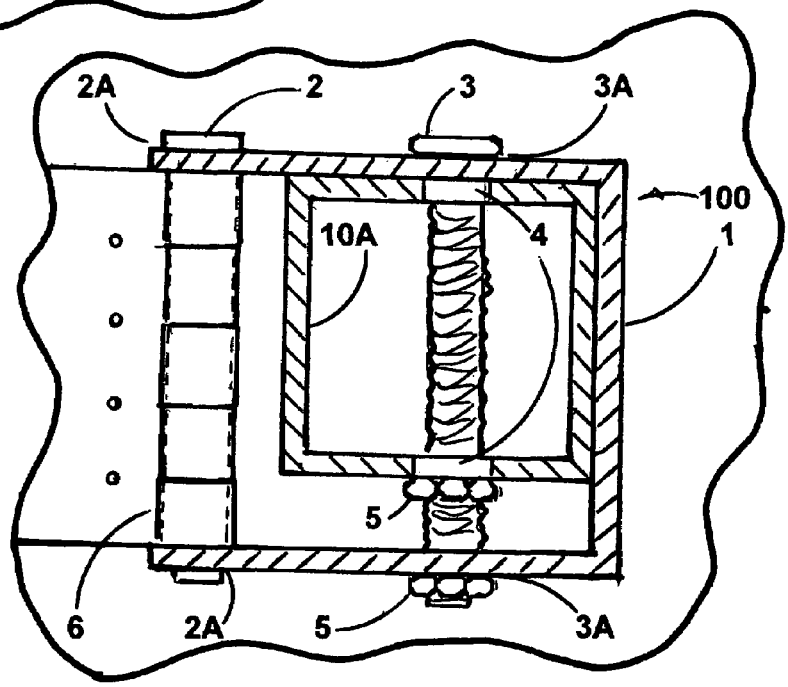
FIG. 5, is an end view of the strut, attachment strap, and attachment method.
Figure 6:
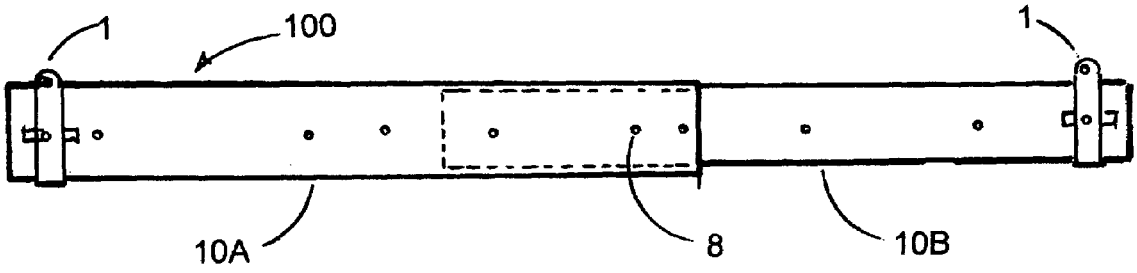
FIGS. 6,7,8, & 9 are top views of the strut showing the plurality of holes needed when the strut is used in varying width situations.
Figure 7:
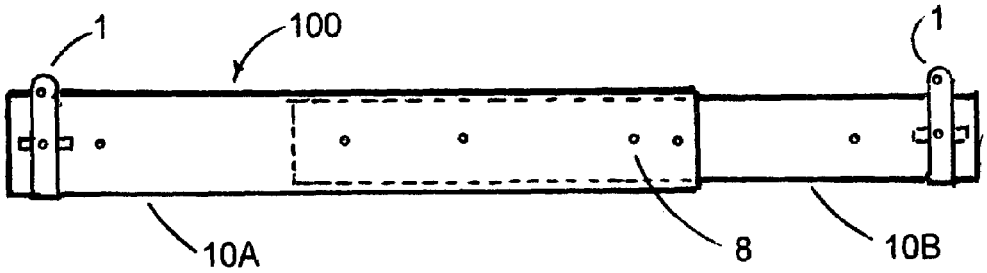
Figure 8:
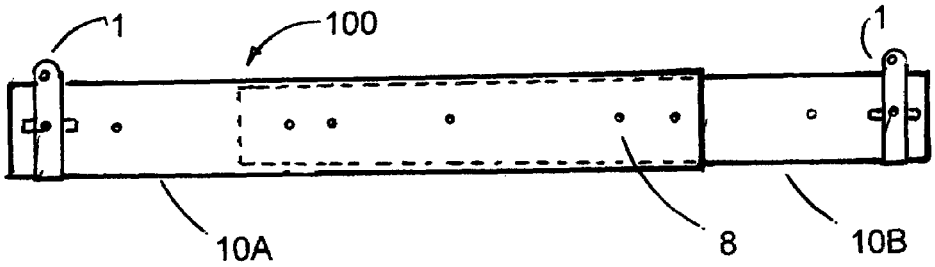
Figure 9:
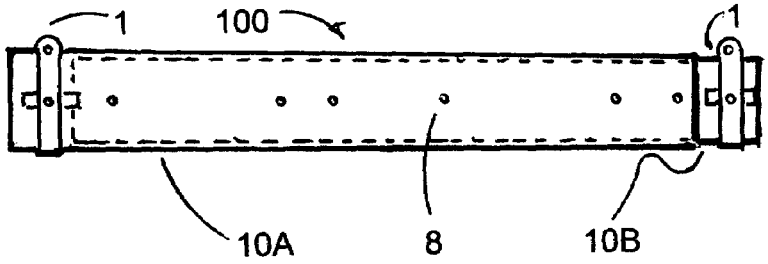

Drawing 3/5, FIG. 4, an isometric perspective view of said square metal tubular strut 100 and FIG. 5 an end view, both showing square metal tube 10A attached to hinge 6 by a metal strap 1 measuring one inch wide by one eight inch thick and ten inches long, a ⅜" hole 2A in each end to receive a 5/16×5 inch replacement hinge pin 2. When bent into a three by four by three inch "U" clamp, strap 1 is attached to the square tube 10A by means of a 5/16×5 inch bolt 3, inserted down through holes 3A of strap 1, from top to bottom penetrating tube 10A, of strut 100 and through ⅜×1 inch slotted holes 4 in the top and bottom of 10A for minor installation adjustment in hinge 6 location. Two nuts 5 retain strap 1 and the square metal tube 10A in a fixed position. FIGS. 4 and 5 are that of a left end view of strut 100, the opposite or right end of said strut 100 having square metal tube 10B with all other segments similar to that of FIGS. 4 & 5.

DRAWING 4/5, FIGS. 6,7,8, and 9 are top views of the telescoping strut 100 shown with square metal tubes 10A and 10B in four respective positions. A plurality of ⅜ inch holes 8, of predetermined preferred location, are shown on the top planar surfaces of strut 100 as a means to secure the two segments 10A and 10B together, when used in any of the four telescoping positions. Strut 100 is shown with attaching strap 1 on each end. Said strut 100 is unique in that it can be adjusted to fit on double three foot doors as well as double two foot eight doors, double two foot six doors and double two foot doors.

Figure 10:
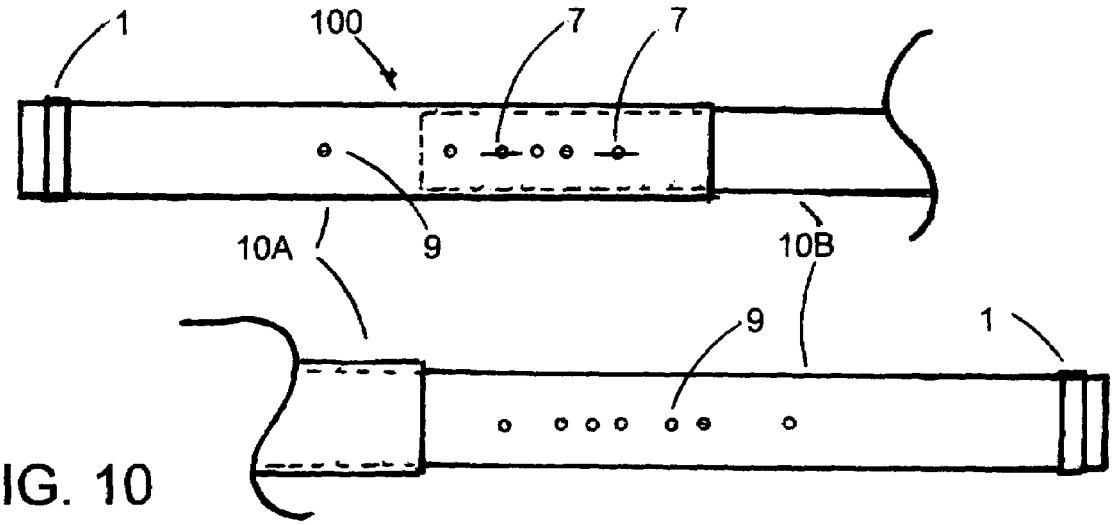
FIG. 10, is an elevation or face view of the strut, showing the position of the torque screw assembly.
Figure 11:
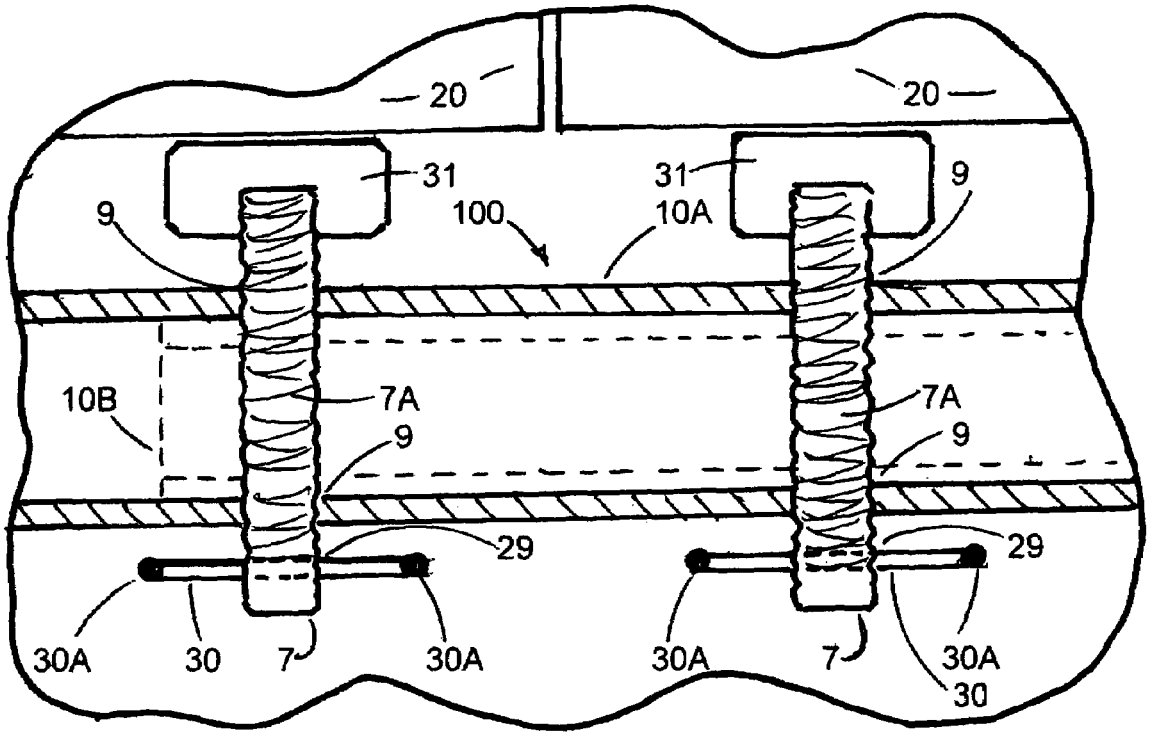
FIG. 11, is an exploded section view of the torque screw assembly.

DRAWING 5/5, FIG. 11, is an exploded cut-away section of FIG. 10, showing the configuration of the torque screw assemblies 7. Torque screw assembly 7, consists of a pair of threaded rods 7A, of predetermined length, wire and thread size and each having a torque screw lever arm 30 inserted through hole 29 in said torque screw 7A and round stay ends 30A, on one end and a removable pressure foot 31 with companion threads as that of screw 7A, on the other end and when threaded through the square tube 10A and 10B of strut 100 in the compatible threaded holes 9, also shown in FIG. 10, adjust firmly to doors 20 to stop any deflection to said doors 20 in wind load situations.

SUMMARY AND SCOPE OF THE INVENTION

Although the description above contains many specificities relative to my invention, these should not be construed as limiting the scope of the invention but simply provide illustrations of the presently preferred embodiments of this invention, for example: this invention with its numerous specifications as to the assembly might be altered with respect to its dimensions and materials and continue to be within the scope of this invention. Modifications may occur by those persons skilled in the art, however those minor modifications are intended to be within the scope of this invention.

I claim:

1. A hurricane strut system comprising; a pair of pivoting doors within a doorway with each door having at least one hinge and hinge pin for pivoting movement; inner and outer tubular telescoping members with first ends telescopically engaged and second ends adjacent to the hinge attached to each side of the doorway; U-shaped straps fixedly attached to the second ends of the tubular members and ends of the U-shaped straps are fixed to the hinge pin, the second ends of the tubular members have a slotted bolt-hole and a bolt extending therein which fixedly mounts and adjusts the U-shaped straps to the second ends of the tubular members; the tubular members further having a plurality of aligning holes for adjustment across the doorway and at least two screws inserted within the aligning holes such that the at least two screws penetrates and extends beyond both sides of the tubular members thereby preventing the doors from movement by high winds when the strut system is in a fixed position.

2. The strut system of claim 1 further comprising the at least two screws are provided with a removable pressure foot for contacting at least one of the doors.

3. The strut system of claim 1 further comprising the at least two screws are torque screws.

* * * * *